US008233580B2

(12) United States Patent
Bedeschi

(10) Patent No.: US 8,233,580 B2
(45) Date of Patent: Jul. 31, 2012

(54) METHOD AND SYSTEM FOR PRODUCING RADIOISOTOPES

(75) Inventor: Paolo Bedeschi, Castel Bolognese (IT)

(73) Assignee: Comecer S.p.A., Castel Bolognese (IT)

( * ) Notice: Subject to any disclaimer, the term of this patent is extended or adjusted under 35 U.S.C. 154(b) by 665 days.

(21) Appl. No.: 11/922,727

(22) PCT Filed: Jun. 22, 2006

(86) PCT No.: PCT/EP2006/063466

§ 371 (c)(1),
(2), (4) Date: Aug. 5, 2009

(87) PCT Pub. No.: WO2006/136602

PCT Pub. Date: Dec. 28, 2006

(65) Prior Publication Data

US 2009/0296872 A1 Dec. 3, 2009

(30) Foreign Application Priority Data

Jun. 22, 2005 (EP) ..... 05425451

(51) Int. Cl.
*G21G 1/00* (2006.01)
*G21G 1/10* (2006.01)

(52) U.S. Cl. ..... 376/202; 376/190

(58) Field of Classification Search ..... 376/195, 376/198, 201, 202
See application file for complete search history.

(56) References Cited

U.S. PATENT DOCUMENTS

| | | | | |
|---|---|---|---|---|
| 4,487,738 | A | 12/1984 | O'Brien, Jr. et al. | |
| 5,037,602 | A | 8/1991 | Dabiri et al. | |
| 6,011,825 | A * | 1/2000 | Welch et al. | 376/195 |
| 2005/0121337 | A1 * | 6/2005 | Van Den Winkel | 205/704 |

FOREIGN PATENT DOCUMENTS

| | | | |
|---|---|---|---|
| JP | 01102397 | | 4/1989 |
| SU | 245214 | A * | 2/1970 |
| SU | 245214 | A | 2/1970 |
| SU | 496757 | | 8/1977 |
| SU | 496757 | A * | 9/1977 |
| SU | 786086 | B | 12/1982 |
| SU | 786086 | * | 1/1983 |
| SU | 760636 | A | 3/1986 |
| SU | 760636 | A * | 3/1986 |
| SU | 1465415 | A | 3/1989 |
| SU | 1465415 | A * | 3/1989 |
| SU | 1029559 | A1 * | 11/1993 |
| SU | 1029559 | A1 | 11/1993 |
| WO | WO-97/07122 | A | 2/1997 |

OTHER PUBLICATIONS

Zhang Chunfu et al., "Cyclotron production of no-carrier-added palladium-103 by bombardment of rhodium-103 target", Applied Radiation and Isotopes, vol. 55, pp. 441-445 (2001).*

* cited by examiner

*Primary Examiner* — Johannes P Mondt
(74) *Attorney, Agent, or Firm* — Dickstein Shapiro LLP

(57) ABSTRACT

A system for automatic production of radioisotopes includes an irradiation unit connectable to a cyclotron and having an electrolytic cell; a purification unit for purifying the radioisotope formed in the irradiation unit; two conduits for transferring an irradiated and electrodissolved target from the irradiation unit to the purification unit; and a central control unit for controlling both the operating units and the transfer means. The method for producing radioisotopes is such that the target carrier is not dissolved together with the irradiated target.

10 Claims, 4 Drawing Sheets

METHOD AND SYSTEM FOR PRODUCING RADIOISOTOPES

TECHNICAL FIELD

The present invention relates to a system for automatic production of radioisotopes.

BACKGROUND ART

Radioisotopes have long been produced by medium- or low-energy (5-30 MeV) irradiation for medical purposes, and are used in many important industrial and scientific applications, foremost of which is as tracers: radioactive drugs are synthesized by reactions with appropriate non-radioactive precursors, and, when administered in the human body, permit Positron Emission Tomography (PET) diagnosis and therapy monitoring, particularly of tumours. By measuring radiation, it is also possible to monitor transformations of the element and/or related molecule, which is useful in chemistry (reaction mechanism studies), biology (metabolism genetics studies), and, as stated, in medicine for diagnosis and therapy.

In known systems for producing radioisotopes, the only automated passage is between the irradiation station and the purification station, where the desired radioisotope is separated from both the target-carrier material and the non-reacting target and any impurities (WO9707122).

Moreover, in known production systems, the target-carrier, on which the metal isotope for irradiation is deposited, is dissolved together with the irradiated target and subsequently removed from the formed radioisotope by means of a purification process.

In other words, in the above known systems, the target, once deposited on the target-carrier, is set up manually at the irradiation station, and purification is more complex and time-consuming than necessary to simply separate the formed radioisotope from the starting isotope.

DISCLOSURE OF INVENTION

It is an object of the present invention to provide a system for automatic production of radioisotopes, designed to improve radioisotope production efficiency, in terms of output, as compared with the known state of the art.

According to the present invention, there is provided a system for automatic production of radioisotopes, characterized by comprising an irradiation unit connectable to a cyclotron; a purification unit for purifying the radioisotope formed in said irradiation unit; transfer means for transferring the irradiated target from the irradiation unit to the purification unit; and a central control unit for controlling both the operating units and the transfer means; said irradiation unit comprising electrodeposition means for electrodepositing a target on a target-carrier, and electrodissolution means for electrodissolving the irradiated said target.

In a preferred embodiment, the electrodeposition and electrodissolution means comprise an electrolytic cell.

BRIEF DESCRIPTION OF THE DRAWINGS

A non-limiting embodiment of the invention will be described by way of example with reference to the accompanying drawings, in which.

BEST MODE FOR CARRYING OUT THE INVENTION

Figure 1:
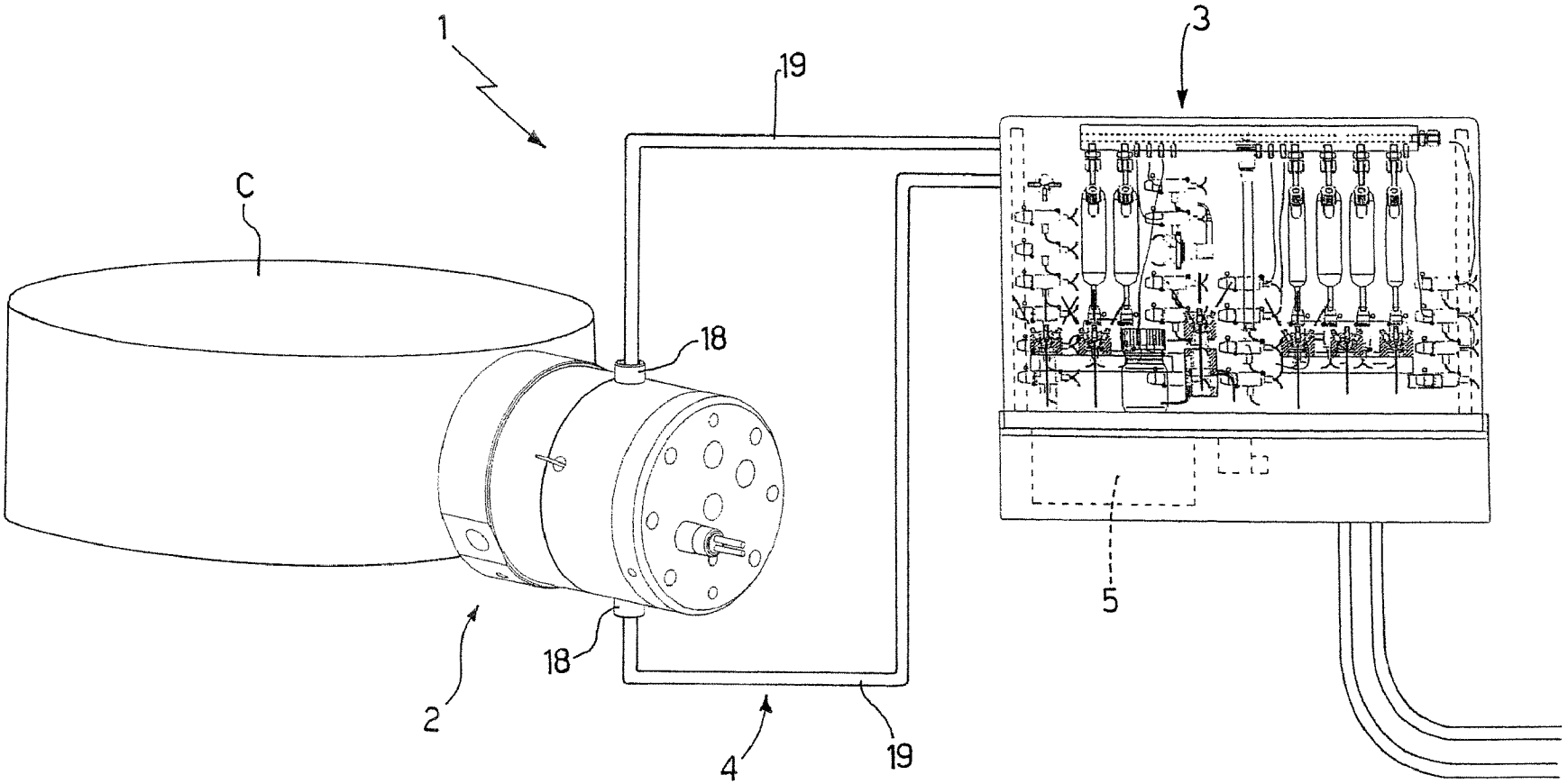
FIG. 1 shows an overall view of the system for automatic production of radioisotopes, in accordance with a preferred embodiment of the present invention.

Number 1 in FIG. 1 indicates as a whole the system for automatic production of radioisotopes according to the present invention.

System 1 comprises an irradiation unit 2 connected directly to a cyclotron C; a purification unit 3; transfer means 4 connecting irradiation unit 2 to purification unit 3; and a central control unit 5 for overall operational control of system 1.

Figure 2:
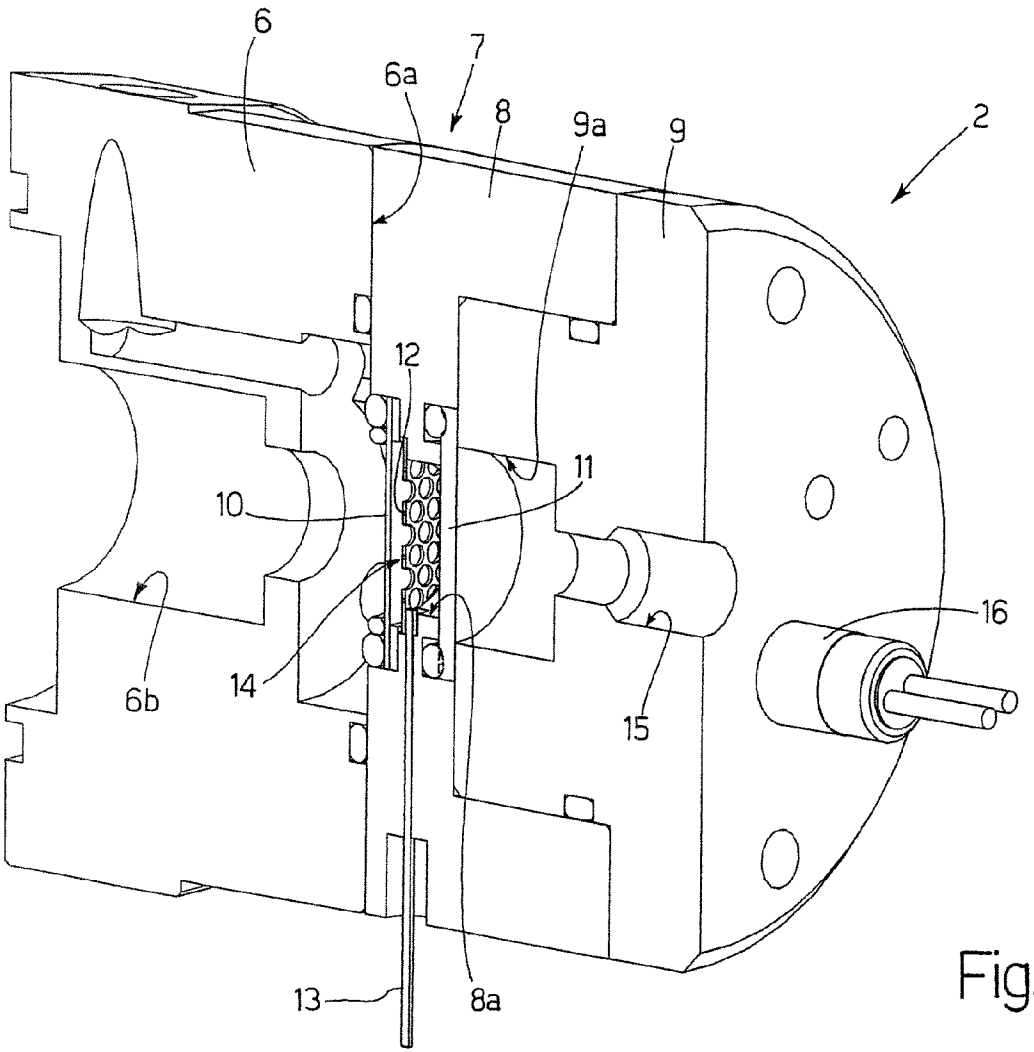
FIG. 2 shows a first longitudinal section of the irradiation unit of the FIG. 1 system.
Figure 3:
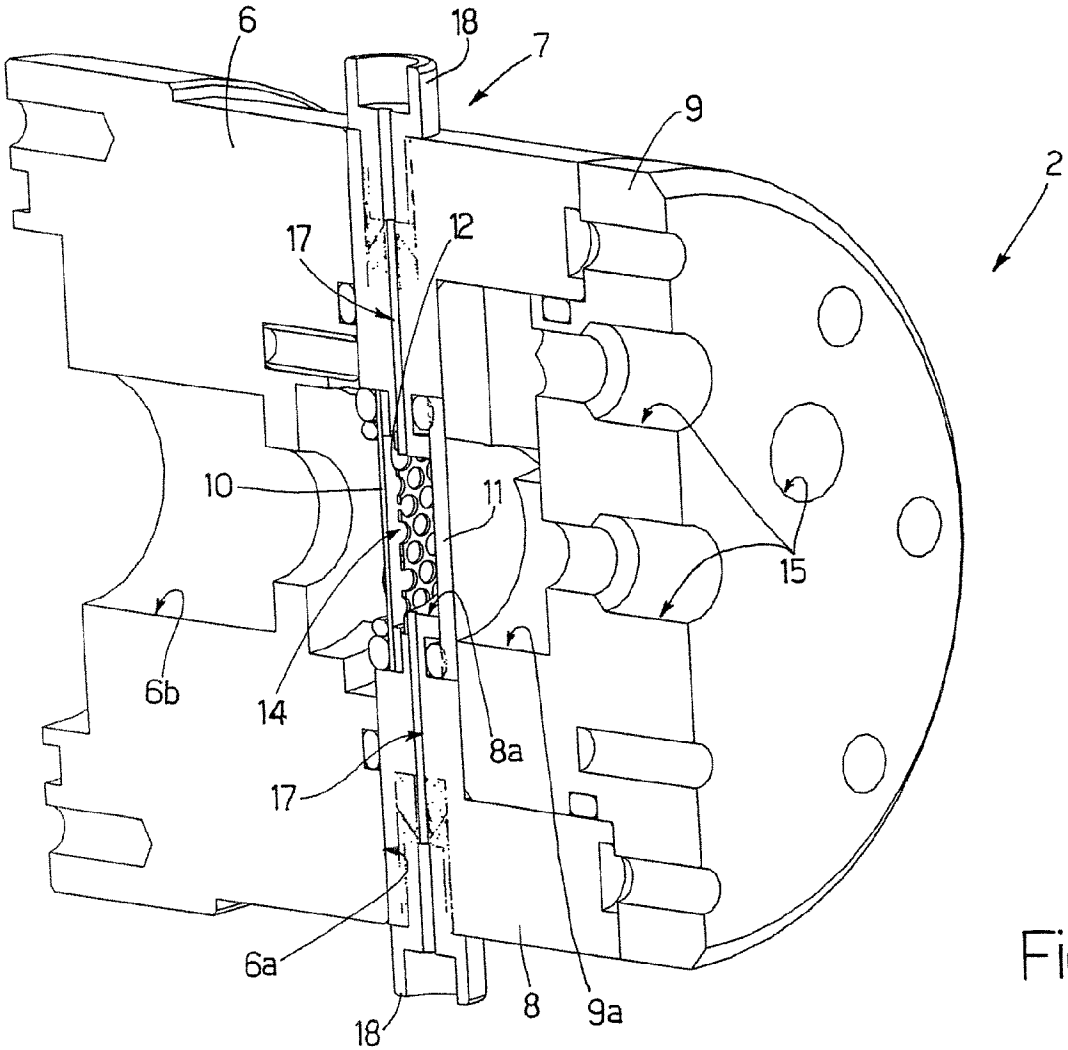
FIG. 3 shows a second longitudinal section, perpendicular to the FIG. 2 section, of the irradiation unit of the FIG. 1 system.

As shown in FIGS. 2 and 3, irradiation unit 2 comprises a collimator 6 which is fixed to cyclotron C; and an electrolysis device 7 for electrodeposition and electrodissolution of the target.

Electrolysis device 7 comprises a spacer flange 8 made of PEEK and contacting an end wall 6*a* of collimator 6; and an end flange 9 contacting spacer flange 8. Spacer flange 8 has a through hole 8*a* collinear with an irradiation conduit 6*b* formed in collimator 6, and end flange 9 has a cylindrical cavity 9*a* facing and collinear with hole 8*a*.

Electrolysis device 7 comprises a teflon-coated aluminium disk 10 closing hole 8*a* and facing collimator 6; a platinum disk 11 closing hole 8*a* and facing cavity 9*a*; and a perforated platinum disk 12 located between and collinear with teflon-coated aluminium disk 10 and platinum disk 11. Perforated platinum disk 12 has a platinum wire 13 projecting radially outwards from flange 8 to act as an electrode as described below.

More specifically, teflon-coated aluminium disk 10 is about 0.5 mm thick to absorb only a minimum part of the energy of the cyclotron beam; and perforated platinum disk 12 is 0.5 mm thick, and has 37 holes of 2 mm in diameter to greatly reduce its mass and so absorb only a minimum part of the energy of the beam.

Inside hole 8*a*, in the gap between teflon-coated aluminium disk 10 and platinum disk 11, an electrolytic cell 14 is formed, in which the target is electrodeposited and electrodissolved on platinum disk 11, which defines the target-carrier.

Three conduits 15, each connected to cylindrical cavity 9*a*, are formed in end flange 9. Two of conduits 15 are coolant inflow and outflow conduits respectively, while the third conduit 15 houses a thermocouple for measuring coolant temperature. The coolant flows directly over platinum disk 11 for fast cooling.

Flange 9 also houses an electric resistor 16, of which FIG. 2 only shows the electric connector projecting outwards of flange 9. Resistor 16 heats the liquid in cavity 9*a* to indirectly heat platinum disk 11 and assist electrodeposition and electrodissolution.

As shown in FIG. 3, two diametrically-opposite, radial conduits 17 are formed in spacer flange 8, and each of which connects electrolytic cell 14 with the outside of flange 8, and terminates with a fitting 18 for connection to a respective conduit 19 defining transfer means 4, as shown in FIG. 1.

In actual use, conduits 17 are positioned vertically to effectively fill and empty electrolytic cell 14.

Figure 4:
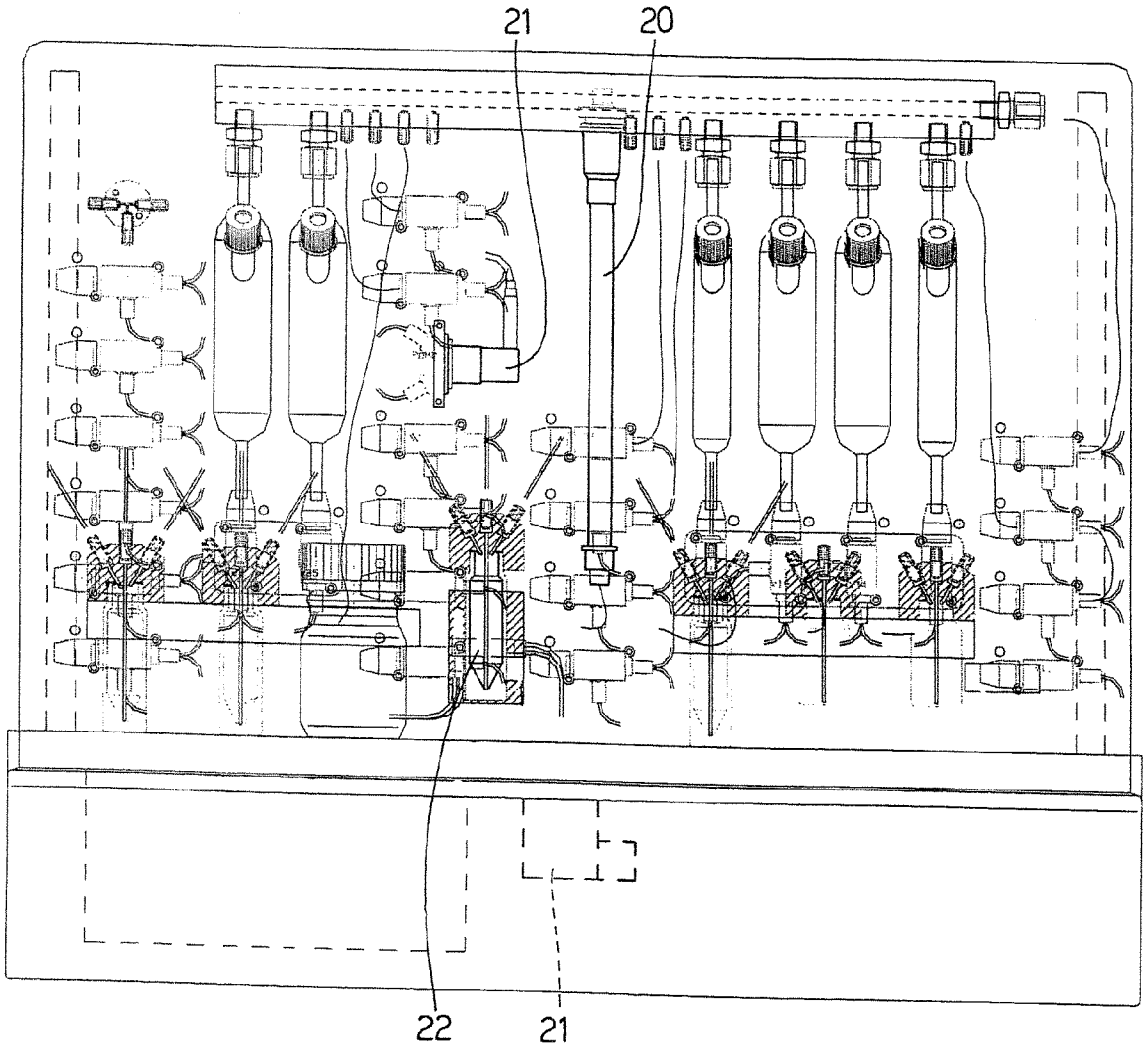
FIG. 4 shows a front view of the purification unit of the FIG. 1 system.

As shown in FIG. 4, purification unit 3 comprises an ionic purification column 20, two pumps 21, a reactor 22, and a network of valves and vessels, and is electronically controlled to supply electrolytic cell 14 with the appropriate electrolytic solution, containing the isotopes of the metals for electrodeposition, and with an $HNO_3$ solution for electrodissolving the irradiated target; to separate the radioisotope from the starting isotope and other radioactive impurities by ion chromatography; and to supply solvents for cleaning electrolytic cell 14, conduits 17, and the component parts used to separate the radioisotope.

In actual use, an electrolytic solution from purification unit 3, and in which the isotope of the metal to be deposited is dissolved, is fed into electrolytic cell 14 along bottom conduit 17 to fill the cell upwards and expel any air. As the solution flows in, the potential difference is applied to the electrodes defined by platinum disk 11 and perforated platinum disk 12, and the isotope to be irradiated is deposited on platinum disk 11. Once the isotope is deposited, the electrolytic solution is removed, and electrolytic cell 14 is cleaned with deionized water and ethyl alcohol successively, which are later removed using a stream of helium. The stream of helium is fed into the electrolytic cell along the top conduit to ensure thorough removal of the liquids along the bottom conduit and thorough drying of the cell. Once the cleaning solvents are eliminated, the target is irradiated.

Once the target is irradiated, an acid solution from purification unit 3, and comprising nitric or hydrochloric acid, is fed into electrolytic cell 14 along bottom conduit 17, and platinum disk 11 is appropriately heated by resistor 16.

At this point, electrodissolution is performed by inverting the polarity of the electrodes with respect to electrodeposition, and the resulting solution is fed along conduits 19 to purification unit 3 by a stream of inert gas.

Once the acid solution is removed from electrolytic cell 14, irradiation unit 2 is cleaned with deionized water and ethyl alcohol, and is dried by a stream of helium fed in along the top conduit.

The acid solution produced by electrodissolution, and containing both the starting metal isotope and the radioisotope produced by irradiation, is transferred to reactor 22 where the nitric acid is evaporated. The isotope/radioisotope mixture is again dissolved in a hydrochloric acid solution, radioactivity is measured, and the solution is transferred in a stream of helium to ionic purification column 20. The starting metal isotope is recovered and used again for further depositions.

For greater clarity, the preparation of two radioisotopes is described below by way of example.

—preparation of radioisotope $^{60}Cu$, $^{61}Cu$, $^{64}Cu$—

A 10 ml ($^{60}Ni$, $^{61}Ni$, $^{64}Ni$) solution comprising nickel sulphate and boric acid is fed into a vessel in purification unit 3. The nickel-containing acid solution is circulated inside electrolytic cell 14 at a temperature ranging between 25° and 50° C. by a closed-circuit system fed by one of pumps 21. When the desired temperature is reached, the voltage control is activated automatically and turns on the voltage and current supply set beforehand to 3V and 20 mA. Electrodeposition lasts, on average, 24 hours, after which, the system is arrested, and, once the electrolytic solution is removed from the circuit, electrolytic cell 14 is cleaned using deionized water and ethyl alcohol successively. Once the cleaning solvents are removed, platinum disk 11 is heated to 60° C. and maintained in a stream of gas for at least 15 minutes to dry the surface of the nickel deposit. The average yield of the metal nickel on platinum disk 11 corresponds to 50±2% of the initially dissolved nickel. Once the above operations are completed, the target is irradiated.

Once the target is irradiated, a 5 ml nitric acid 4M solution, fed beforehand into a vessel in purification unit 3, is circulated for about 10-20 minutes at a flow rate of 0.5-2 ml/min inside electrolytic cell 14, while platinum disk 11 is heated to a temperature ranging between 25 and 50° C. In these conditions, electrodissolution of the target is quantitative. Once the target is dissolved, the acid solution containing the dissolved nickel and the resulting radioisotope ($^{60}Cu$, $^{61}Cu$, $^{64}Cu$) is transferred automatically to purification unit 3, where the resulting radioisotope ($^{60}Cu$, $^{61}Cu$, $^{64}Cu$) is purified to remove the respective starting nickel isotope and any other radioactive and metal impurities.

—preparation of radioisotope $^{110}In$—

A 10 ml cadmium-110 solution comprising cadmium fluoborate and ammonium fluoborate is fed into a vessel in purification unit 3 and to electrolytic cell 14. The acid solution is circulated inside electrolytic cell 14 at a temperature of 30° C. and a flow rate of 0.5-2 ml/min by a closed-circuit system fed by one of pumps 21. In these conditions, 0.02 A current and 3V voltage are applied for roughly 4-6 h necessary to deposit at least 40 mg of cadmium-110. Once electrodeposition is completed, the system is cleaned with deionized water and ethyl alcohol, and, once the cleaning solvents are removed, platinum disk 11 is heated to 60° C. and maintained in a stream of gas for at least 15 minutes to dry the surface of the cadmium-110 deposit.

Once the above operations are completed, the target is irradiated.

Once the target is irradiated, a 4 ml nitric acid 4M solution, fed beforehand into a vessel in purification unit 3, is circulated for about 2 minutes at a flow rate of 0.5-2 ml/min inside electrolytic cell 14, while platinum disk 11 is maintained at ambient temperature. In these conditions, electrodissolution of the target is quantitative. Once the target is dissolved, the acid solution containing cadmium-110/indium-110 is transferred automatically to purification unit 3, where the indium-110 undergoes ionic purification to remove the cadmium-110 and any other radioactive and metal impurities.

By providing for electrodissolution of the irradiated metal, the system according to the present invention avoids dissolving the target-carrier, with obvious advantages at the purification stage.

Moreover, the fact that the irradiation unit comprises an electrolysis device for depositing the target makes the system as a whole extremely practical.

Finally, the system is extremely versatile, considering the collimator need simply be changed to adapt the irradiation unit to different cyclotrons.

The invention claimed is:

1. A system (1) for automatic production of radioisotopes, characterized by comprising an irradiation unit (2) connectable to a cyclotron (C); a purification unit (3) for purifying the radioisotope formed in said irradiation unit (2); transfer means (4) for transferring the irradiated target from the irradiation unit (2) to the purification unit (3); and a central control unit (5) for controlling the irradiation unit (2), the purification unit (3), and the transfer means (4); said irradiation unit (2) comprising an electrolytic cell (14) wherein a target is electrodeposited on a target carrier (11) defining an electrode and wherein said target, once irradiated, is electrodissolved to be transferred to the purification unit (3) by said transfer means (4).

2. A system as claimed in claim 1, characterized in that said electrolytic cell (14) is defined between a teflon-coated aluminium disk (10) and a platinum disk (11); said platinum disk (11) defining an electrode of said electrolytic cell (14) and being said target carrier.

3. A system as claimed in claim 2, characterized in that said irradiation unit (2) comprises a collimator (6) which is fixed to a cyclotron (C); and an electrolysis device (7) comprising said electrolytic cell (14).

4. A system as claimed in claim 3, characterized in that said electrolysis device (7) comprises a spacer flange (8) made of PEEK and contacting an end wall (6*a*) of the collimator (6); and an end flange (9) contacting the spacer flange (8); said spacer flange (8) having a hole (8*a*) for housing said electrolytic cell (14); and said end flange (9) having a cylindrical cavity (9*a*) facing and collinear with said hole (8*a*).

5. A system as claimed in claim 4, characterized in that said teflon-coated aluminium disk (10) and said platinum disk (11) close the hole (8*a*) in said spacer flange (8).

6. A system as claimed in claim 5, characterized by comprising a perforated platinum disk (12) located between and collinear with said teflon-coated aluminium disk (10) and said platinum disk (11), and which acts as an electrode in said electrolytic cell (14).

7. A system as claimed in claim 6, characterized in that two diametrically-opposite, radial conduits (17) are formed in said spacer flange (8) to fill and empty the electrolytic cell (14).

8. A system as claimed in claim 7, characterized in that three conduits (15) are formed in said end flange (9), are connected to the cylindrical cavity (9*a*), and provide for coolant inflow and outflow and for housing a thermocouple for measuring coolant temperature respectively.

9. A system as claimed in claim 8, characterized in that said end flange (9) houses an electric resistor (16).

10. A system as claimed in claim 9, characterized in that said transfer means (4) comprise two conduits (19), each of which has a first end connected to said irradiation unit (2), and a second end connected to said purification unit (3).

* * * * *